US006027207A

United States Patent [19]

Reinten et al.

[11] Patent Number: 6,027,207

[45] Date of Patent: Feb. 22, 2000

[54] INK JET NOZZLE HEAD WITH MULTIPLE BLOCK STRUCTURE

[75] Inventors: Hans Reinten, Velden; Peter Joseph Hollands, Baarlo, both of Netherlands

[73] Assignee: Océ-Nederland B.V., Venlo, Netherlands

[21] Appl. No.: 08/895,890

[22] Filed: Jul. 17, 1997

[30] Foreign Application Priority Data

Jul. 18, 1996 [EP] European Pat. Off. ..... 96202044

[51] Int. Cl.[7] ..... B41J 2/045

[52] U.S. Cl. ..... 347/68; 347/71

[58] Field of Search ..... 347/70, 71, 72, 347/10, 11, 68, 69, 94; 310/348, 368

[56] References Cited

U.S. PATENT DOCUMENTS

| | | | |
|---|---|---|---|
| 5,761,783 | 6/1998 | Osawa et al. | 347/70 |
| 5,860,202 | 1/1999 | Okawa et al. | 347/70 |

FOREIGN PATENT DOCUMENTS

| | | |
|---|---|---|
| 0402172 | 12/1990 | European Pat. Off. . |
| 0402172B1 | 12/1990 | European Pat. Off. . |
| 36300206A1 | 3/1987 | Germany . |
| 119511408A1 | 10/1995 | Germany . |

OTHER PUBLICATIONS

Patent Abstract of Japan #JP3293143 A, Date: Dec. 24, 1991.

Patent Abstract of Japan #JP4371846 A, Date: Dec. 24, 1992.

Patent Abstract of Japan #JP5238009 A, Date: Sep. 17, 1993.

*Primary Examiner*—John Barlow
*Assistant Examiner*—Sydney O. Johnson, Jr.

[57] ABSTRACT

An ink jet nozzle head including a channel plate defining a linear array of equidistanced nozzles and a plurality of substantially parallel ink channels communicating with an associated nozzle, a vibration plate disposed on the channel plate, a plurality of separately disposed block members, each containing a comb-like array of fingers which extend toward and engage the vibration plate, some fingers functioning as actuators for exerting mechanical pressure on ink contained in the ink channels which in turn expels ink droplets from the nozzle, at least one actuator being provided for each nozzle, and other fingers serving as support members for supporting the actuators at the vibration plate, where the reaction forces of the actuators are received, wherein each block comprises at least one actuator and at least one support member.

20 Claims, 3 Drawing Sheets

INK JET NOZZLE HEAD WITH MULTIPLE BLOCK STRUCTURE

BACKGROUND AND SUMMARY OF THE INVENTION

The present invention relates to a nozzle head for use in an ink jet printer.

A nozzle head having the features specified hereinbelow is disclosed in EP-A-0 402 172. This nozzle head comprises a channel plate defining a linear array of equidistant nozzles and a plurality of parallel ink channels, each connected to a respective one of the nozzles. On one side of the channel plate there is disposed an array of elongate fingers projecting towards the nozzle plate and extending in parallel with the ink channels. The ends of these fingers facing away from the channel plate are interconnected by a plate-like backing member which is formed integrally with the fingers. The fingers and the backing plate are made of a piezoelectric ceramic material. Every second finger is provided with electrodes and serves as an actuator which, when a print signal is applied to the electrodes, compresses the ink liquid contained in the associated ink channel, so that an ink droplet is expelled from the nozzle. The other fingers intervening between the actuators serve as support members which are rigidly connected to the channel plate so that they can absorb the reaction forces generated by the actuators.

Since a support member is provided between each pair of consecutive actuators, each actuator is substantially shielded against the reaction forces from its neighbors, so that undesired cross-talk between the various channels is reduced.

However, when one of the actuators is activated, e.g. expanded, the support members adjacent thereto on both sides are elastically deformed to some extent, so that the backing plate is slightly deflected. This effect becomes more significant when a plurality of neighboring actuators are activated simultaneously, whereby the stresses applied to the backing plate are accumulated. In this case the deformation of the backing plate will also affect the actuators which are disposed at a comparatively large distance from the active actuators and will cause the generation of parasitic acoustic waves in the ink channels where no droplets are to be expelled. Thus, there exists a problem which can be termed "long-range cross-talk."

It is an object of the present invention to provide a nozzle head in which long-range cross-talk can be suppressed more efficiently. According to the present invention, the array of fingers is divided into a number of separate blocks, and each block comprises only one support member and only one or two actuators.

As a result, the reaction forces of the actuator or actuators of one block are directly absorbed by the support member of the same block and are confined to this particular block, so that they will have substantially no effect on the other blocks. Thus, the undesired long-range cross-talk phenomenon is largely eliminated.

The use of not more than two actuators per block has the advantage that the spatial configuration of the actuators in relation to the support member and the borders of the block is the same for all actuators of the array, except for mirror symmetry in case of two actuators disposed on both sides of the support member. Thus, the subdivision of the array of fingers into separate blocks will not cause any differences in the performance of the actuators during the process of droplet generation.

In a preferred embodiment of the present invention, each block has two actuators disposed on either side of the support member. This has the advantage that the density with which the fingers (actuators and support members) are arranged in the direction of the linear nozzle array is only 3/2 of the density of the nozzles. As a result, when the density of the nozzles is reduced for enhancing the resolution of the print head, the pitch of the fingers remains comparatively large which facilitates the manufacture of the array of fingers.

In this embodiment, there may occur a certain amount of cross-talk between the two channels associated with the same block. However, since the number of different energizing patterns which have to be considered in this case is small, an electronic compensation of the cross-talk by appropriately controlling the voltages applied to the actuators is greatly facilitated. In fact, only two cases have to be taken into consideration, i.e. (a) the case in which only one of the two actuators is energized and (b) the case in which both actuators of the block are energized. For compensating the cross-talk in these two cases, it is therefore sufficient to provide two different sets of voltages to be applied to the two actuators.

The array of fingers may be additionally supported by a separate backing member disposed on the side of the array opposite to the channel plate and extending over all the blocks. This backing member should however have a comparatively high flexibility, so that the mechanical coupling between the various blocks is limited to a tolerable amount. More preferably, the backing member has an anisotropic rigidity, such that it is comparatively stiff in the direction parallel with the ink channels but is rather flexible in the direction transverse to the ink channels. This can be achieved for example by a grid-like backing member having a number of beams extending longitudinally of the ink channels and each being disposed over one of the blocks.

BRIEF DESCRIPTION OF THE DRAWINGS

Preferred embodiments of the invention will now be described in conjunction with the accompanying drawings, in which.

DETAILED DESCRIPTION OF THE INVENTION

Figure 1:
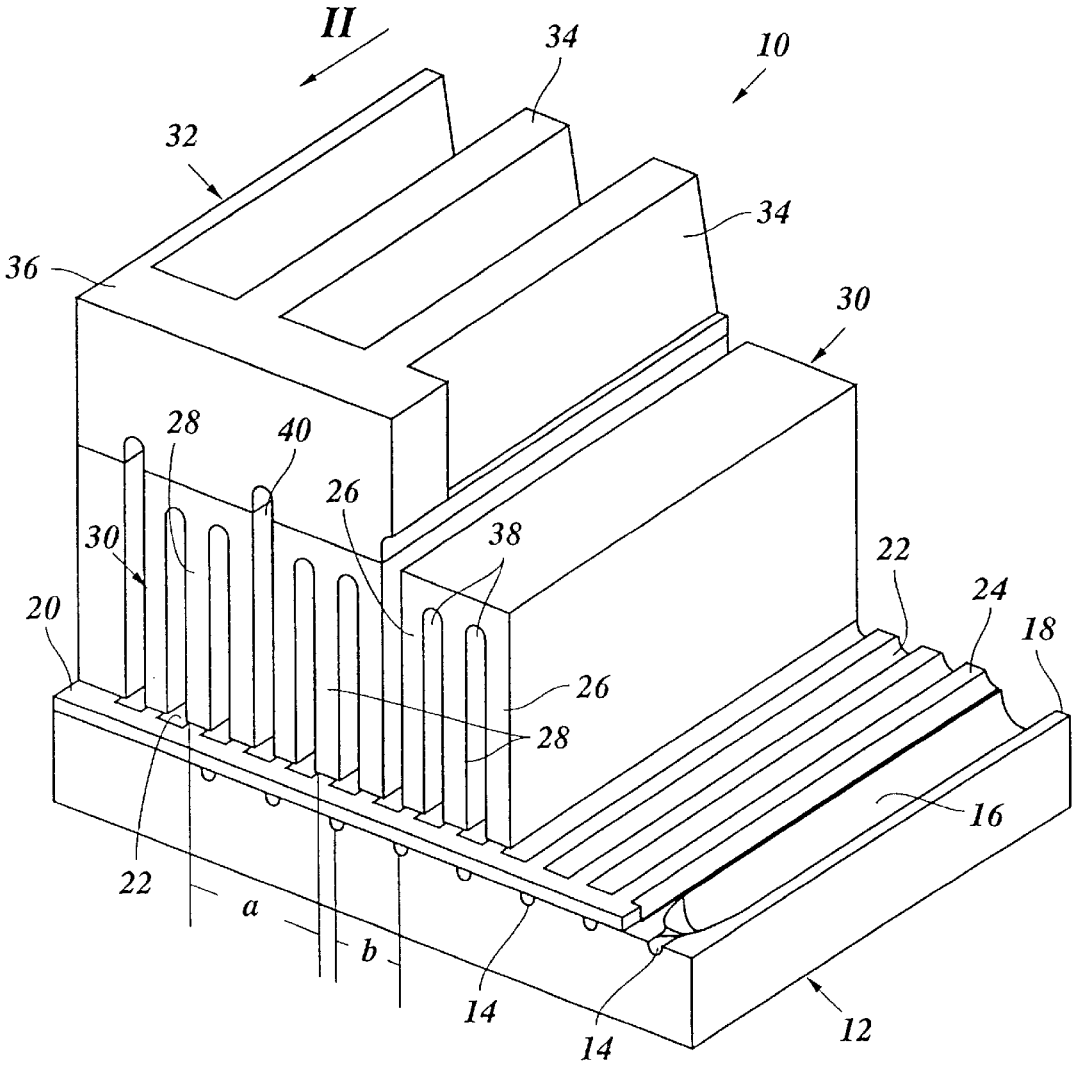
FIG. 1 is a partly broken-away perspective view of a nozzle head according to a first embodiment of the present invention.
Figure 2:
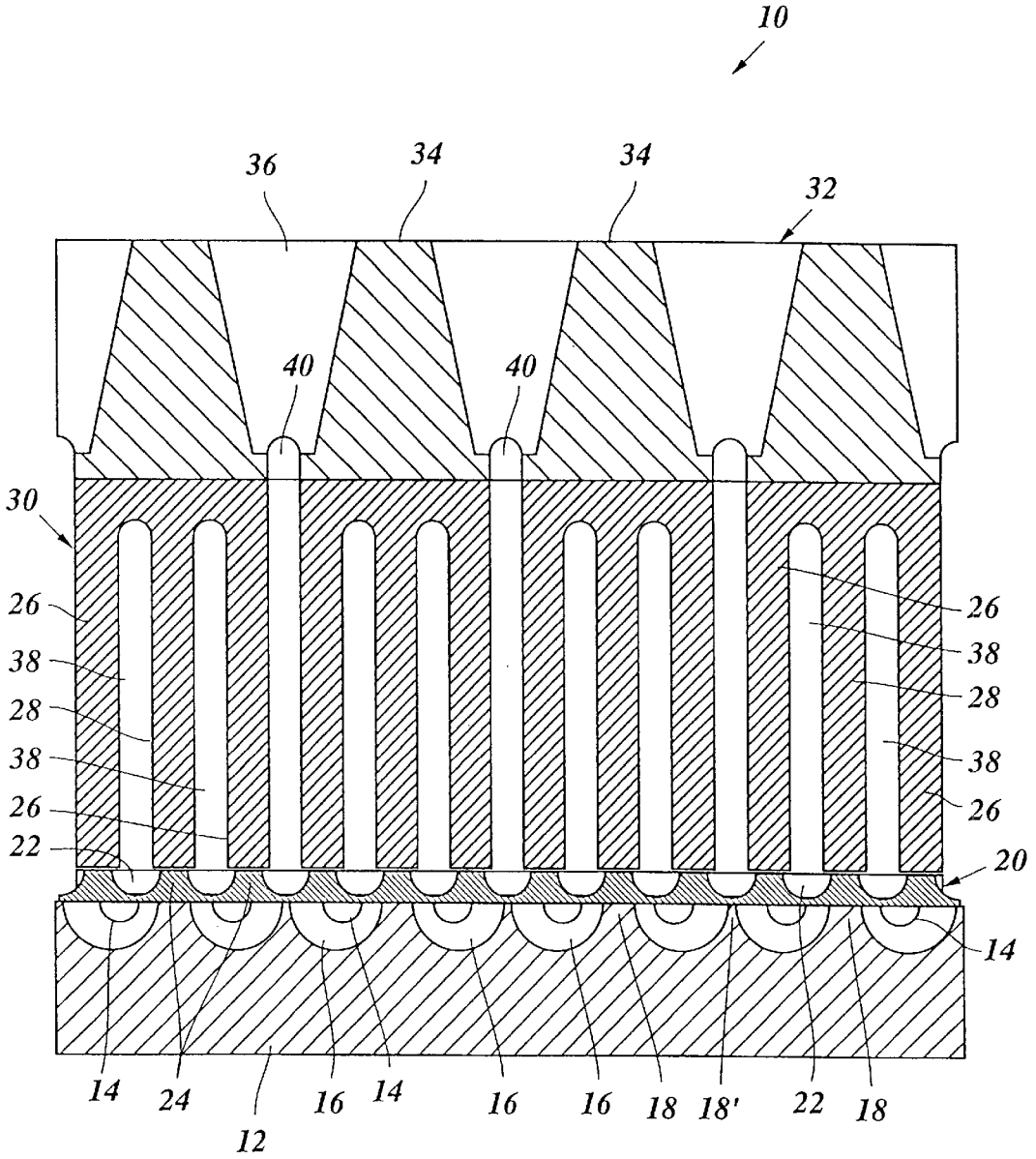
FIG. 2 is a cross-sectional view in the direction of the arrow II in FIG. 1.

The nozzle head 10 illustrated in FIGS. 1 and 2 comprises a channel plate 12 which defines a linear array of nozzles 14 and a number of parallel ink channels 16, only one of which is shown in FIG. 1. The nozzles 14 and the ink channels 16 are formed by grooves cut into the top surface of the channel plate 12. Each nozzle 14 is connected to an associated ink channel 16. The ink channels are separated by dam portions 18, 18'.

The top sides of the nozzles 14 and the ink channels 16 are closed by a thin vibration plate 20, which is securely bonded to the dam portions of the channel plate.

The top surface of the vibration plate 20 is formed with a series of grooves 22 which extend in parallel with the ink channels 16 and are separated by ridges 24. The ends of the grooves 22 adjacent to the nozzles 14 are slightly offset from the edge of the vibration plate 20.

An array of elongate fingers 26, 28 is disposed on the top surface of the vibration plate 20 such that each finger extends in parallel with the ink channels 16 and has its lower end fixedly bonded to one of the ridges 24. The fingers are grouped in triplets, each triplet consisting of a central finger 28 and two lateral fingers 26. The fingers of each triplet are interconnected at their top ends and are formed by a one-piece block 30 of piezoelectric material.

Each of the fingers 26 is associated with one of the ink channels 16 and is provided with electrodes (not shown) to which an electric voltage can be applied in accordance with a printing signal. These fingers 26 serve as actuators which expand and contract in the vertical direction in response to the applied voltage, so that the corresponding portion of the vibration plate 20 is deflected into the associated ink channel 16. As a result, the ink liquid contained in the ink channel (e.g. a hot-melt ink) is pressurized and an ink droplet is expelled from the nozzle 14.

The central fingers 28 are disposed over the dam portions 18 of the channel plate and serve as support members which absorb the reaction forces of the actuators 26. For example, if one or both actuators 26 belonging to the same block 30 are expanded, they exert an upwardly directed force on the top portion of the block 30. This force is largely counterbalanced by a tension force of the support member 28 the lower end of which is rigidly connected to the channel plate 12 via the ridge 24 of the vibration plate.

The top ends of the blocks 30 are flush with each other and are overlaid by a backing member 32. The backing member 32 is formed by a number of longitudinal beams 34 extending in parallel with the ink channels 16 and by transverse beams 36 which interconnect with the ends of the longitudinal beams 34 (only one of the transverse beams is shown in FIG. 1).

The longitudinal beams 34 have a trapezoidal cross section and are originally interconnected with each other at their broader base portions, so that they form a continuous plate. In a subsequent manufacturing step, a comparatively thick layer of piezoelectric material which will later form the blocks 30 is bonded to the plate, i.e. to the lower surface of the backing member 32 in FIG. 1. Then, the blocks 30 and the fingers 26, 28 are formed by cutting grooves 38, 40 into the piezoelectric material. While the grooves 38 which separate the fingers 26 and 28 terminate within the piezoelectric material, the grooves 40 separating the blocks 30 are cut into the backing member 32, thereby also separating the longitudinal beams 34 from one another.

Thus, the width of the longitudinal beams 34 is essentially equal to the width of the individual blocks 30. As a consequence, the beams 34 efficiently prevent an elastic deformation of the top portions of the blocks 30 when the actuators 26 expand and contract.

Since the support members 28 inevitably have a certain elasticity, expansion of one or both actuators 26 of one of the blocks 30 will also cause a minor expansion of the support members 28 and will tend to cause a slight deflection of the backing member 32. If the backing member were a non-profiled flat plate, this deflective force would be transmitted to the neighboring blocks 30 and would lead to the generation of parasitic acoustic waves in the neighboring ink channels, thereby creating what is known as cross-talk. Such long-range cross-talk may cause problems, especially when a large number of actuators in neighboring blocks 30 are energized simultaneously. However, since the backing member 32 is formed by separate beams 34 which are only interconnected at their opposite ends by the transverse beams 36, and these transverse beams are additionally weakened by the grooves 40, the deflective forces are substantially confined to the blocks from which they originate. Thus, the long-range cross-talk phenomenon can be effectively suppressed.

The subdivision of the array of fingers 26, 28 into separate blocks 30 each consisting of only three fingers also facilitates the further suppression of short range cross-talk, i.e. cross-talk between the ink channels associated with the same block 30. To this end, it is sufficient to make a distinction between two cases: (a) only one of the two actuators 26 is energized; (b) both actuators are energized. In the case (b), the support member 28 will be subject to a larger elastic deformation than in the case (a). This effect can easily be compensated by slightly increasing the voltage applied to the actuators in the (b) case. It should be noted that this measure will not lead to an increased long-range cross talk, because the blocks 30 are separated from each other.

In the (a) case, the top portion of the block 30 and the beam 34 will be caused to slightly tilt about the top end of the support member 28, thereby compressing the ink in the neighboring channel. However, this effect will be very small due to the stabilizing effect of the transverse beams 36. If necessary, this minor effect can also be compensated for by applying a small compensation voltage with appropriate polarity to the actuator associated with the non-firing channel.

Since the support members 28 are made of a piezoelectric material, it is also possible to provide additional electrodes for the support members 28 in order to actively counterbalance the reaction forces of the actuators 26.

In the shown embodiment, the width of the grooves 40 is identical to the width of the grooves 38, and the fingers 26, 28 are equidistantly arranged. The pitch "a" of the support members 28 is larger than the pitch "b" of the nozzles 14 by a factor 2. Since every third finger is an actuating member 26, the pitch of the fingers 26, 28 is 2b/3, in comparison to a pitch of b/2 for the conventional case in which a support member is provided between each pair of adjacent ink channels. As a result, the pitch "b" of the nozzles and hence the resolution of the print head can be made small without exceeding the limits imposed by the manufacturing process for the piezoelectric actuators and support members.

In a practical embodiment the pitch "b" of the nozzles 14 may be as small as 250 m (i.e. four nozzles per millimeter). The pitch of the support members 28 will accordingly be 500 m, and the pitch of all the fingers (including the actuators 26) will be 167 m. In this case, the width of each individual finger 26 or 28 may for example be 87 m, and the grooves 38, 40 will have a width of 80 m and a depth in the order of 0.5 mm.

FIG. 2 shows the grooves 22 and ridges 24 of the vibration plate 20. The nozzles 14 and the ink channels 16 are not evenly distributed over the length of the nozzle array. Instead, the ink channels 16 are grouped in pairs separated by comparatively broad dam portions 18, whereas the ink channels of each pair are separated by a comparatively narrow dam portion 18'. The broad dam portions 18 coincide with the ridges 24 of the vibration plate and with the support members 28, whereas the smaller dam portions 18' coincide with the grooves 22 of the vibration plate and the grooves 40 between the blocks 30. The width of the ink channels 16 (at the top surface of the channel plate 12) is larger than the width of the fingers 26, 28, and the ink channels are offset relative to the nozzles 14 to such an extent that none of the actuators 26 overlaps with the dam portions 18, 18'.

The portions of the vibration plate 20 on both sides of the ridges 24 which are held in contact with the actuators 26 are weakened by the grooves 22, and at least a major part of these weakened portions is still within the area of the ink channels 16. Thus, the vibration plate 20 can be readily flexed into the ink channel 16 in response to expansion strokes of the actuators 26. The width of the ridges 24 is slightly smaller than that of the fingers 26, 28.

With the above configuration, excessive bending or shearing stress in the vibration plate 20 near the edges of the dam portions 18, 18' is avoided, so that a high durability of the vibration plate 20 can be achieved.

The vibration plate 20 may be formed by a relatively soft resin foil, e.g. a soft foil of a polyimide resin, which is welded to the channel plate 12 and to the ends of the fingers 26, 28. Alternatively, the vibration plate may be formed by a thin film of glass or a metal, e.g. aluminum, which is soldered to the channel plate and the fingers.

While a specific embodiment of the present invention has been described above, it will be obvious to a person skilled in the art that various modifications can be made which would fall within the spirit and scope of the invention. For example, the width of the actuators 26 may be different from that of the support members 28. Likewise, the width of the grooves 40 may be different from that of the grooves 38, resulting in an uneven distribution of the fingers 26, 28.

Figure 3:
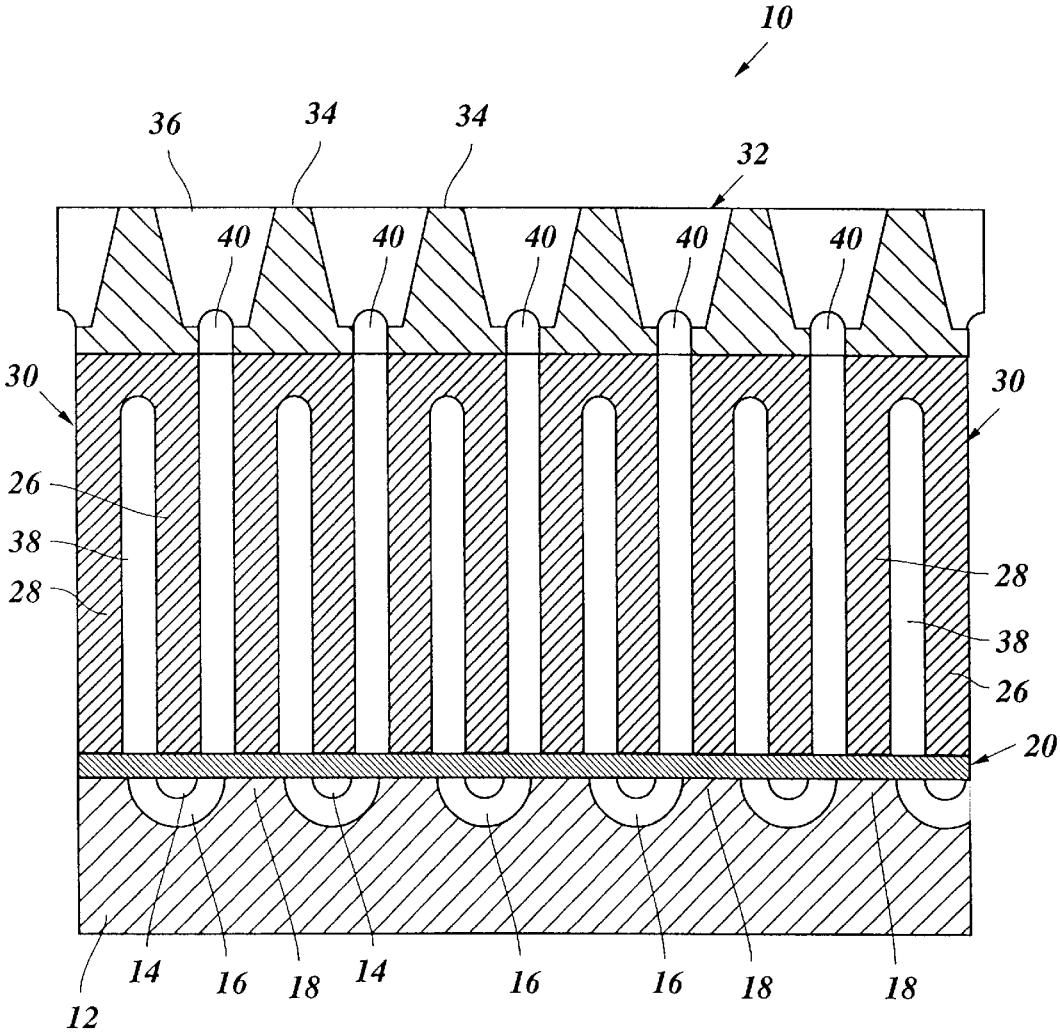
FIG. 3 is a view similar to FIG. 2 but showing a second embodiment of the present invention.

FIG. 3 shows an embodiment in which there is a one-to-one relationship between the support members 28 and the nozzles 14, and each block 30 consists only of two fingers, i.e. one support member 28 and one actuator 26. The ink channels 16 are arranged equidistantly, without being offset relative to the corresponding nozzles 14. Also, the vibration plate 20 has a uniform thickness.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink jet nozzle head comprising:

a channel plate defining a linear array of equidistanced nozzles and a plurality of substantially parallel ink channels communicating with an associated nozzle, a vibration plate disposed on said channel plate, a plurality of separately disposed block members, each containing a comb-like array of fingers which extend toward and engage said vibration plate, some fingers functioning as actuators for exerting mechanical pressure on ink contained in the ink channels which in turn expels ink droplets from the nozzle, at least one actuator being provided for each nozzle, and other fingers serving as support members for supporting the actuators at the vibration plate, where reaction forces of the actuators are received, wherein each block comprises one actuator and one or two support members.

2. The nozzle head of claim 1, wherein the vibration plate is disposed on said channel plate above said ink channels and said nozzles.

3. The nozzle head of claim 1, wherein pitch "a" of the support member is twice pitch "b" of the nozzles.

4. The nozzle head of claim 1, wherein each block member comprises two actuators disposed on opposite sides of a support member.

5. The nozzle head of claim 1, wherein the fingers are evenly distributed over the length of the nozzle array.

6. The nozzle head of claim 1, wherein the fingers are separated by grooves, with the grooves provided between fingers of the same block having a smaller depth than the grooves which separate adjacent blocks.

7. The nozzle head of claim 1, wherein backing members are disposed on the block members, said backing members having a higher flexibility in the transverse direction of the ink channels than in the longitudinal direction thereof.

8. The nozzle head of claim 7, wherein the grooves separating the block members are extended into the backing member.

9. The nozzle head of claim 7, wherein the backing member comprises a number of beams extending in the longitudinal direction of the ink channels and disposed over each of the blocks, respectively.

10. The nozzle head of claim 1, wherein said vibration plate has an upper and lower surface, said lower surface being bound to the channel plate to define said nozzles and channels and said upper surface being formed with a plurality of grooves which extend substantially parallel to the ink channels, said grooves being separated by ridges.

11. The nozzle head of claim 10, wherein each finger extends substantially parallel to the ink channels with a lower end thereof being fixedly bonded to one of the ridges.

12. The nozzle head of claim 1, wherein the finger functioning as actuators are associated with one of the ink channels and are provided with electrodes to which an electric voltage is applied in response to a printing signal.

13. The nozzle head of claim 1, wherein upper ends of the block members are flush with each other and are overlaid by the backing members.

14. The nozzle head of claim 3, wherein because every third finger is an actuating member, a pitch of the fingers is 2b/3.

15. The nozzle head of claim 1, wherein the nozzles and the ink channels are not evenly distributed over the length of the nozzle array.

16. The nozzle head of claim 1, wherein there is provided a one-to-one relationship between the support members and the nozzles with each block consisting of one support member and one actuator.

17. The nozzle head of claim 16, wherein the ink channels are arranged equidistantly and the vibration plate has a uniform thickness.

18. The nozzle head of claim 1, wherein the vibration plate is made of a soft resin or a thin film.

19. The nozzle head of claim 18, wherein the soft resin is a polyimide resin.

20. An ink jet printer utilizing an ink jet nozzle head comprising:

a channel plate defining a linear array of equidistanced nozzles and a plurality of substantially parallel ink channels communicating with an associated nozzle, a vibration plate disposed on said channel plate, a plurality of separately disposed block members, each containing a comb-like array of fingers which extend toward and engage said vibration plate, some fingers functioning as actuators for exerting mechanical pressure on ink contained in the ink channels which in turn expels ink droplets from the nozzle, at least one actuator being provided for each nozzle, and other fingers serving as support members for supporting the actuators at the vibration plate, where reaction forces of the actuators are received, wherein each block comprises at least one actuator and at least one support member.

* * * * *